United States Patent [19]

Schroeder et al.

[11] Patent Number: 4,794,708

[45] Date of Patent: Jan. 3, 1989

[54] TRENCHING MACHINE BOOM ASSEMBLY

[75] Inventors: Philip W. Schroeder, Derby; Marvin L. Morris, Wichita; Stephen A. Youngers, Clearwater, all of Kans.

[73] Assignee: J. I. Case Company, Racine, Wis.

[21] Appl. No.: 154,704

[22] Filed: Feb. 11, 1988

[51] Int. Cl.[4] ..... E02F 5/06

[52] U.S. Cl. ..... 37/86; 337/191 A; 172/119; 172/125; 299/64; 299/76

[58] Field of Search ..... 37/86, 89, 92, 94, 191 A, 37/DIG. 17; 299/36, 39, 64, 76; 172/119, 125

[56] References Cited

U.S. PATENT DOCUMENTS

| | | | |
|---|---|---|---|
| 2,748,504 | 6/1956 | McIninch | 37/86 |
| 2,846,786 | 8/1958 | Barber et al. | 37/86 |
| 3,087,354 | 4/1963 | Malzahn | 37/86 X |
| 3,623,246 | 11/1971 | Skomial et al. | 37/86 |
| 3,668,794 | 6/1972 | Marquardt et al. | 37/89 X |
| 3,711,158 | 1/1973 | Butcher | 37/94 X |
| 3,754,341 | 8/1973 | Caldwell et al. | 37/86 |
| 4,327,508 | 5/1982 | Youngers | 37/86 |
| 4,483,084 | 11/1984 | Caldwell et al. | 37/86 |
| 4,660,306 | 4/1987 | Bruce et al. | 37/117.5 X |
| 4,742,627 | 5/1988 | Lindstrom | 37/86 |

*Primary Examiner*—E. H. Eickholt

*Attorney, Agent, or Firm*—Cullen, Sloman, Cantor, Grauer, Scott & Rutherford

[57] ABSTRACT

A trencher machine digging boom assembly having a mounting arrangement for the digging boom wherein the boom includes a boom attaching weldment that is pivotally mounted to a boom pivot casting. The boom pivot casting is rigidly mounted to a trencher frame with a drive motor being mounted to one end of the boom pivot casting and a planetary gearbox being mounted at its opposite end. The planetary gearbox and associated drive components for the digging chain may be disconnected to permit easy and convenient removal of the digging boom for replacing its pivot bearings. Further, the torque reactions of the drive train are maintained within the boom pivot casting and are not transferred to the lift components associated with the digging boom.

1 Claim, 1 Drawing Sheet

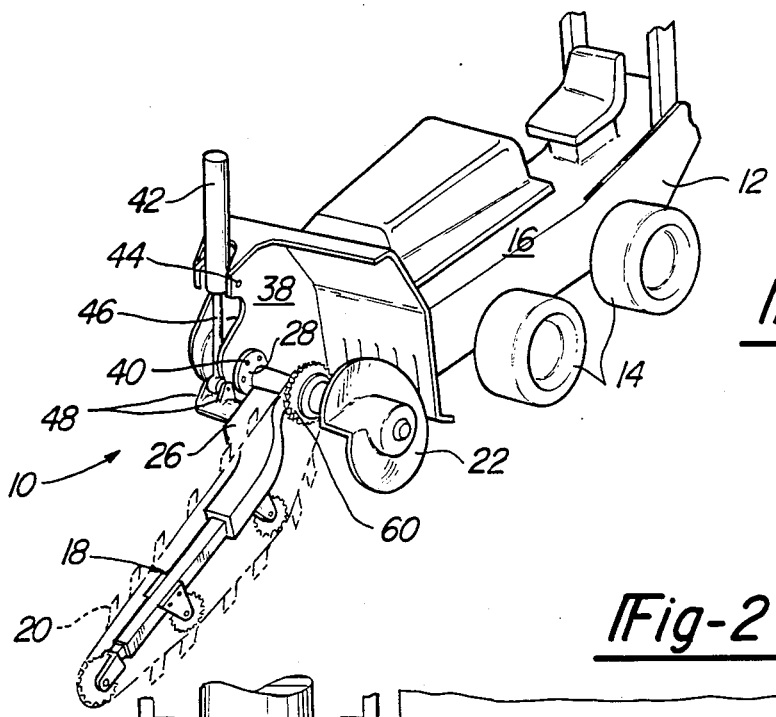
Fig-1
Fig-2
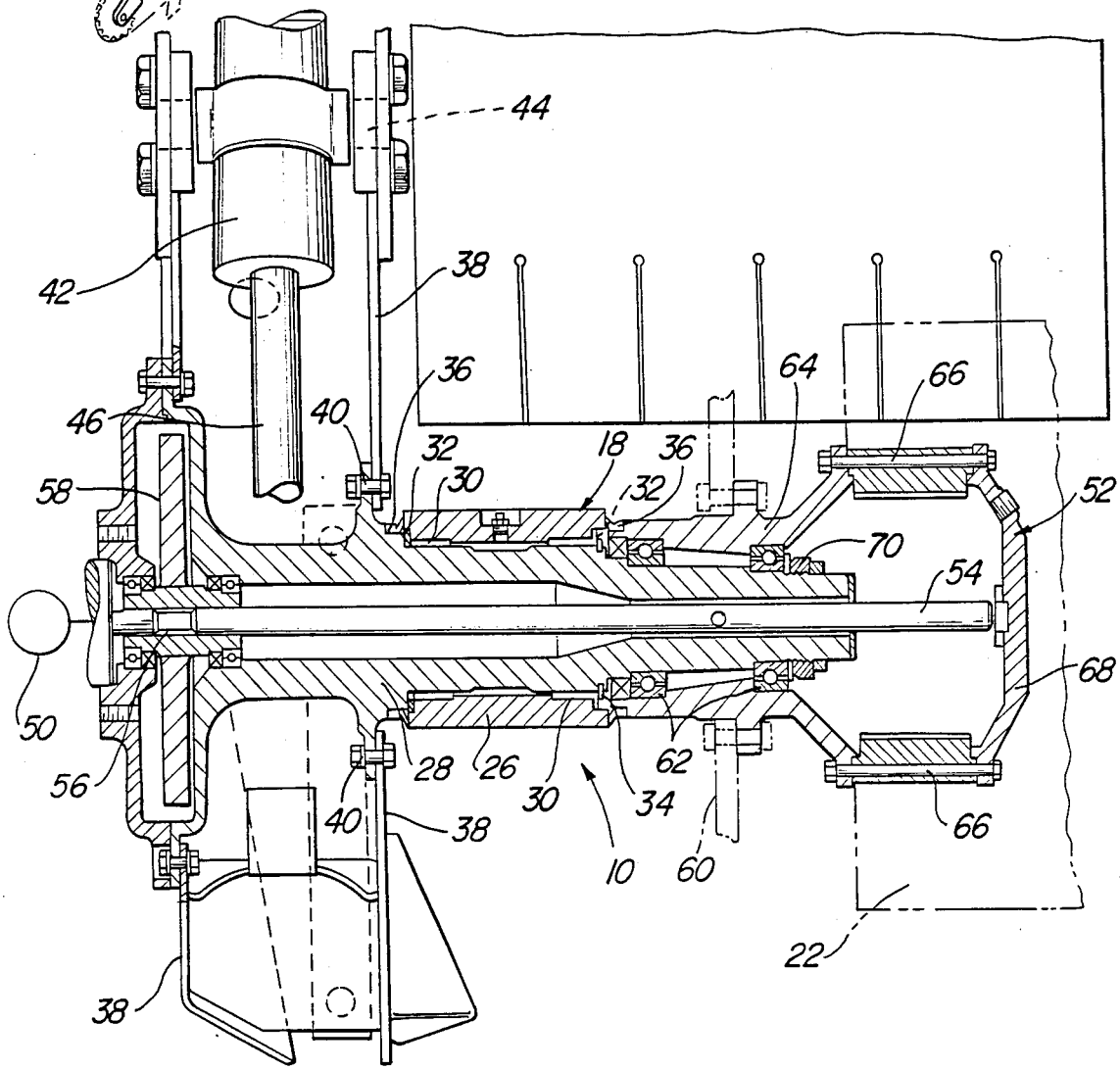

TRENCHING MACHINE BOOM ASSEMBLY

BACKGROUND OF THE INVENTION

The present invention relates to a boom assembly for a hydrostatically operated trenching machine, and more particularly, to a boom assembly wherein the digging boom is pivotally connected to a casting that is rigidly mounted to the trencher frame.

It is conventional to provide a hydrostatically operated trenching machine having a digging boom which is connected to a tractor for pivotal movement. A digging chain is rotatably mounted on the boom and driven for digging in the ground, and an auger is provided which disperses the spoil that is dug during the trenching operation to the sides of the trench. An example of a trenching machine of the type just described is disclosed and illustrated in U.S. Pat. No. 4,327,508, which is assigned to the assignee of the present invention.

The trenching machine disclosed in U.S. Pat. No. 4,327,508 includes a totally enclosed drive train assembly for the digging chain drive sprocket and spoil dispersing auger. A generally cylindrical boom lift casting is mounted to the tractor frame by a pair of pivot bearings such that the digging boom and boom casting pivot in the trencher frame. A boom lift cylinder is mounted in the trencher frame and attached to the boom lift casting of rotating the boom. The assembly further includes a hydraulic drive motor which is mounted to one end of the boom lift casting and a planetary gearbox which is mounted to the opposite end of the boom lift casing with the planetary gearbox being drivingly connected to the hydraulic drive motor. A digging chain drive sprocket is connected to the planetary gearbox housing to receive the rotational driving force transmitted to the gearbox by the hydraulic motor. Moreover, the planetary gearbox includes a housing for rotatably mounting the auger such that the rotational driving force of the hydraulic motor is transmitted to the auger through the planetary gearbox.

As the boom pivot bushings wear in this known construction, the entire boom assembly may become loose which could result in some misalignment of the drive components. Further, the torque reactions within the drive train assembly are transferred through the boom lift casting and into the boom lift cylinder. These reactions can be substantial when, for example, the digging chain comes in contact with a rock. Thus, there has been a need for an improved digging boom assembly to overcome these disadvantages and undesirable results.

SUMMARY OF THE INVENTION

The disclosed hydrostatically operated trenching machine includes a drive train assembly comprising a hydraulic drive motor, a rotatable drive sprocket subassembly, a planetary gearbox, and a boom pivot casting. The hydraulic drive motor is drivingly connected to the planetary gearbox by means of a drive shaft that passes through the boom pivot casting.

The planetary gearbox is mounted on one end of the boom pivot casting and includes a rotatably driven housing for mounting the spoil dispersing auger. The auger receives the rotational driving force transmitted by the hydraulic motor to the housing through the planetary gearbox. The digging chain drive sprocket subassembly is rotatably mounted on the boom pivot casting adjacent the planetary gearbox. It is connected to the driven gearbox housing to receive the rotational driving force transmitted to the gearbox by the hydraulic motor. Thus, a single drive assembly powers both the digging chain drive sprocket and auger.

The present invention relates more specifically to an improved mounting arrangement for the digging boom wherein the boom includes a boom attaching weldment that is pivotally mounted to the boom pivot casting by means of pivot bearings. The boom pivot casting is rigidly moutned to the trencher frame and a boom lift cylinder is attached to the boom attaching weldment for pivoting the digging boom on the boom casting.

Thus, the digging boom assembly of the present invention includes a boom pivot casting which is mounted rigidly to the trencer frame such that the digging boom pivots on the boom pivot casting and is rotated by the boom lift cylinder that is attached externally to the digging boom. The present construction permits easy and convenient removal of the boom pivot bearings which eliminates the prior disadvantage wherein the entire boom assembly can become loose as the pivot bushings wear thereby permitting possible misalignment of the drive components. Further, with the present construction, torque reactions of the trencher drive train are not transferred through the boom pivot casting into the boom lift cylinder. Other advantages and meritorious features of the present invention will be more fully understood from the following detailed description of the invention, the appended claims, and the drawings, a brief description of which follows.

BRIEF DESCRIPTION OF DRAWINGS

FIG. 1 is a perspective view of a trenching machine embodying the digging boom assembly of the present invention.

FIG. 2 is a cross-sectional view illustrating the pivotal connection between the digging boom and boom pivot casting and the drive train assembly for the trenching machine.

DETAILED DESCPRITION OF THE INVENTION

A perferred embodiment of a hydrostatically operated trenching machine including the digging boom assembly 10 made in accordance with the teachings of the present invention is illustrated in FIGS. 1–2.

The hydrostatically operated trenching machine shown in FIG. 1 is seen to include a tractor 12 with ground engaging wheels 14 and an engine 16. A trenching or digging boom 18 is mounted for pivotal movement and a digging chain 20 is rotatably mounted to the trenching boom for digging in the ground. An auger 22 is provided which disperses the spoil that is dug during the trenching operation to the sides of the trench. Further, a crumber (not shown) is rotatably mounted to the trenching boom 18 for cleaning the bottom of the trench during the digging operation.

The present invention more specifically realates to the digging boom assembly 10 and to an improved mounting arrangement for the trenching boom 18 wherein the trenching boom includes a boom attaching weldment 26 that is pivotally mounted to a boom pivot casting 28 by pivot bearings 30. Thrust washers 32, snap ring and seals 36 are also provided to complete the pivotal connection. If pivot bearings 30 become worn, the boom attaching weldment 26 and digging boom 18 may be easily and conveniently removed from the boom pivot casting to permit replacement of pivot bearings 30, as will be more fully described.

The boom pivot casting 28 is rigidly mounted to trencer frame 38 by fasteners 40. A boom lift cylinder 42 is also attached to the trender frame 38 for movement about pivot 44. The rod end 46 of cylindrer 42 is attached to lugs 48 (FIG. 1) extending from the boom attaching weldment 26. Thus, extension or retraction of cylinder 42 results in pivotal movement of trenching boom 18 about boom pivot casting 28.

A hydraulic drive motor 50 is mounted to one end of the boom pivot casting 28 while planetary gearbox 52 is mounted to its opposite end. The planetary gearbox 52 is drivingly connected to motor 50 by means of a drive shaft 54 that passes through boom pivot casting 28 and a spine connection 56 within flywheel 58. The planetary gearbox 52 includes an outer periphery for rotatably mounting auger 22. The rotationl driving force of motor 50 is transmitted to auger 22 through conventional planetary gears within gearbox 52.

A digging chain sprocet 60 (FIG. 1) is rotatably mounted by bearings 62 on boom pivot casting 28 adjacent to planetary gearbox 52. Gearbox 52 and digging chain sprocket 60 are drivingly interconnected by hub 64. Thus, the rotational driving force received by gearbox 52 from motor 50 is transmitted through gearbox 52 to hub 64, and therefore, digging chain sprocket 60 and auger 22 are driven in unison.

Auger 22 may be installed or removed quickly from planetary gearbox 52. Further, removal of fasteners 66 permits removal of gearbox housing face 68 thereby permitting access within gearbox 52. Moreover, removal of threaded locking fastener 70 permits convenient removal of digging chain sprocket bearings 62 and hub 64.

As described, the planetary gearbox 52 may be conveniently disconnected from drive sprocket hub 64 by removing fasteners 66. Similarly, drive sprocket hub 64 and bearings 62 may be conveniently disconnected from boom pivot casting 28 by removing locking fastener 70. Digging boom 18 may be removed from boom attaching weldment 26 or boom attaching weldment 26 and digging boom 18 may be conveniently removed from boom pivot casting 28 by removing snap ring 34 thereby permitting removal of the subassembly comprising boom attachment weldment 26 and pivot bearings 30. Thus, the boom attaching weldmnet 26 is constructed such that it may be removed from the boom pivot casting 28 in a convenient fashion to permit replacement of the pivot bearings 30. Moreover, the digging boom assembly 10 is constructed such that torque reactions from the drive train comprising motor 50, drive shaft 54, and planetary gearbox 52 are not transferred from the boom pivot casing 28 to the boom lift cylinder 42.

It will be apparent to those skilled in the art that the foregoing disclosure is exemplary in nature with the invention being defined by the appended claims.

We claim:

1. In a trenching machine having a frame and including a digging boom and a digging chain rotatably mounted on said boom, the improvement comprising;

a boom pivot means rigidly mounted to said trencher frame, means for pivotally mounting a boom attaching means to said boom pivot means, said boom connected to said boom attaching means, lift means connected between said frame and boom attaching means for lifting and lowering said boom on said boom pivot means, motor means mounted to one end of said boom pivot means and a gear assembly mounted to the opposite end of said boom pivot means, drive means connecting said motor means to said gear assembly, said boom attaching means pivotally mounted on said boom pivot means between said motor means and said gear assembly, and said boom attaching means being removable from said boom pivot means to permit access to said pivotal mounted means, and said boom attaching means pivotally mounted on said boom pivot means to prevent the transfer of torque reactions from said motor means and gear assembly to said lift means

* * * * *